United States Patent [19]

Elliott

[11] Patent Number: 4,669,860

[45] Date of Patent: Jun. 2, 1987

[54] ELECTROPHOTOGRAPHIC RECORDER CONTROLLER

[75] Inventor: Jennings W. Elliott, Round Rock, Tex.

[73] Assignee: Schlumberger Technology Corporation, Houston, Tex.

[21] Appl. No.: 621,835

[22] Filed: Jun. 18, 1984

[51] Int. Cl.[4] ..... G03G 15/00

[52] U.S. Cl. ..... 355/14 R; 355/3 R; 355/3 CH; 355/14 CH; 355/14 FU; 355/3 SH; 430/124; 118/666; 118/641; 219/216

[58] Field of Search ..... 355/3 R, 14 R, 14 CH, 355/3 CH, 14 FU, 10; 430/124; 118/666, 641; 219/216

[56] References Cited

U.S. PATENT DOCUMENTS

| | | | |
|---|---|---|---|
| 4,075,455 | 2/1978 | Kitamura et al. | 219/216 |
| 4,104,692 | 8/1978 | Sudo et al. | 219/216 X |
| 4,162,847 | 7/1979 | Brandon | 355/14 FU |
| 4,301,359 | 11/1981 | Ito et al. | 219/216 |
| 4,303,334 | 12/1981 | Haupt et al. | f55/14 FU X |
| 4,367,037 | 1/1983 | Nishikawa | 355/14 FU |
| 4,538,902 | 9/1985 | Inuzuka et al. | 355/14 FU |

*Primary Examiner*—A. C. Prescott

*Attorney, Agent, or Firm*—Henry N. Garrana; Michael D. Rostoker

[57] ABSTRACT

A method and apparatus for improving the quality of recordings from electrophotographic recording apparatuses by calculating the surface charge remaining on the recording medium adjacent the development electrode and adjusting the voltage of the development electrode to match the remaining surface charge; controlling the corona charger to operate at two levels, a first level for charging the surface of the recording medium and a second lower level at which neither light nor ions are emitted; controlling the fuser lamp in response to changes in ambient temperature, line voltage, and the rate of recording medium advancement to obtain optimum toner fusion without damage to the recording medium; deactivating the toner pump and air knife blower if the recording medium has not moved for a predetermined period of time, and further including a development electrode design for maintaining a uniform layer of toner adjacent the recording medium.

21 Claims, 12 Drawing Figures

ELECTROPHOTOGRAPHIC RECORDER CONTROLLER

BACKGROUND OF THE INVENTION

The present invention relates generally to well logging recorders. More particularly, the present invention is directed to a method and apparatus for controlling an electrophotographic well logging recording device for improving the clarity of the recordings and to eliminate artifacts and other undesirable markings on the recording. The method and apparatus of the present invention provide for imaging and processing of electrophotographic film, paper or other recording medium in real time over a wide range of throughput speeds.

Electrophotographic processes typically use four operational steps, namely charging, exposing, adding toner, and fusing the toner to electrophotographic recording medium transported between various stations in an electrophotographic processing unit.

The recording medium generally used is a three layer film such as Eastman Kodak type SO-101. That film has a bottom transparent polyester base similar to that used in conventional film. The center layer is a thin conductor which is electrically connected to a metal spool on which the film is wound. The top layer is a photoconductive dielectric. Apart from the light-sensitive properties of the film, the film, in effect, operates as a parallel plate capaciter with one plate missing. If kept away from light, the film can accept and hold a charge for long periods of time. On exposure to light, the photoconductive layer becomes conductive, and the surface charge of the film is reduced.

In general terms, the film is first sensitized by charging the film surface to a potential of approximately +500 to +600 volts. The charging is typically performed by a corona charging unit consisting of a small diameter wire enclosed on three sides by a conductive metal shell. When a high voltage (4–7 kilovolts) is applied between the wire and the shell, the air surrounding the wire is ionized. That results in a flow of ions from the wire to the shell and from the wire to the film surface. That flow of ions charges the surface of the film to the desired potential.

Other recording mediums, of course, are used, and the method and apparatus of the present invention may be used with such other mediums. For ease of explanation, however, the following description will simply refer to the recording medium as a film.

The second step in a typical electrophotographic process is to expose the film to light in the areas where an image is desired. In electrophotographic techniques used in recording operations, the film is typically exposed by passing it over a fiber-optic face plate of a cathode ray tube (a "CRT"). A CRT with fiber-optic face plate allows selective exposure of the film, and results in a latent electrostatic image. The areas of the film that are exposed become conductive, and the surface voltage in those areas is reduced. The discharge path is through the center conductive layer of the film and the film spool to ground. The surface voltage in the exposed areas is thus reduced below that of the surrounding areas from the previously charged level of +500 to +600 volts to 250–300 volts.

The third step is to develop the film by selectively depositing toner particles in the exposed areas, namely those areas with the lowest surface voltage. In typical electrophotographic devices, the film is passed over a toner head which supplies positively charged toner particles to the film surface. Devices using liquid toner typically suspend toner particles in an insulating or dielectric liquid carrier which is pumped through the toner head from a reservoir. The positively charged toner particles are attracted to the exposed areas, and are repelled from the unexposed background areas. After passing over the film surface, the liquid toner returns to a reservoir via a sump generally surrounding the toner head. An air knife is usually used to strip excess liquid from the film as it leaves the toner head.

The last step of the typical electrophotographic process is to render the image permanent by fusing the toner particles to the film. After toning, the image is visible but not permanent, and can be easily smeared or removed. The fusing process heats the toner particles to a point where they are partially melted into the film surface. The toner particles are generally heated by absorption of infrared energy radiated by an infrared lamp.

The film is finally driven through the electrophotographic recorder by a drive mechanism usually consisting of a drive roller driven by a stepper motor, thus allowing the film to be advanced in steps, typically 0.005" per step, with each step synchronized with the scan of a beam across the CRT face plate.

Well logging operations, however, impose additional requirements on an electrophotographic recorder system. The system must be capable of operating over a wide range of speed (for example, 0.005" per second to more than 1" per second). It must produce good image quality without extraneous artifacts (namely, undesired smears, blotches, and other marks) when the film motion is stopped for extended time periods up to or exceeding one hour. It must be capable of normal operation when tilted 10° or more from a horizontal plane and be capable of normal operation over a wide temperature range (for example, 0° C. to +45° C.). It must also be capable of asynchronous operation meaning that the film must be capable of being moved intermittently in addition to uniform rates and be capable of producing long recordings up to hundreds of feet in length with the additional ability to use either transparent film or opaque paper.

Thus, it is a first general object of the present invention to provide a method and apparatus for producing electrophotographic well log recordings meeting those rigorous requirements.

SUMMARY OF THE INVENTION

Several significant problems have long existed in the electrophotographic recording field, but remained unsolved, prior to the advent of the present invention.

The first problem is that of image toning. In order to achieve uniform toning, the liquid toner typically used in electrophotographic recording devices must flow between the film and a planar conductive surface known as a development electrode. That development electrode, in order to obtain best results, should be biased with a voltage of the same polarity and at the same level as the voltage on the unexposed areas of the film. Electrode voltages higher than the voltage on the unexposed areas result in objectionable toning of those areas. If the development electrode is operated at a voltage lower than the voltage on the film, toner is deposited on the electrode, resulting in decreased spacing between the film and electrode due to increasing toner deposits. Increasing layers of toner on the electrode acts as an insulator, thereby reducing the effectiveness of the electrode.

The voltage of the unexposed film over the toner head, however, is a function not only of the initial voltage level imparted to the film by the corona charger, but an inherent time rate of decay referred to as the "dark decay rate" and the elapsed time since that particular portion of film was charged by the corona charger. The dark decay rate is the inherent rate at which voltage on the film decreases without exposure to light. That decay rate cannot be practically measured directly and, furthermore, is dependent upon several variables which in turn are functions of temperature.

Attempts have been made in the past to vary the development electrode voltage in response to predicted decay rates for electrophotographic film, such as described in U.S. Pat. No. 4,319,544, to Weber issued Mar. 16, 1982. The present invention, however, provides, for the first time, a process and apparatus for accurately and continuously predicting the voltage on the film as it enters the toner head taking into consideration all variables and operating over a wide range of time, temperature, and film transport speed. The method and apparatus of the present invention provide for accurately predicting that voltage regardless of whether operation of the film transport is continuous or intermittent. The present invention also provides means for varying the voltage on the development electrode in response to the predicted change in surface charge on the film.

An additional problem long eperienced but unresolved in the art involves the fusing operation. The fusing operation depends on three variables, namely film transport speed, ambient temperature within the electrophotographic film processor or recorder cabinet and AC line voltage. Narrow temperature ranges are encountered and quality recordings require strict temperature control. Good adhesion and cohesion of the toner particles to the film require approximately 80° C. On the other hand, the polyester film base discolors at approximately 100° C. and permanently deforms at approximately 120° C. In addition, the fuser must operate and produce quality recordings over an operating range of 0° to 55° C. of temperature within the recorder, and with AC line voltages varying from 105 to 130 volts, and at film transport speeds from 0 to 1.2 inches per second.

The present invention, for the first time, provides a method and apparatus for sensing the variables of film transport speed, ambient internal processor temperature, and AC line voltage, and applying those variables to control the image fusing process. The result is quality recordings over wide ranges of film transport speeds, ambient temperatures, and AC line voltages.

A further problem encountered in the prior art is that the corona charger emits light as well as ions. That light can strike the film after it has passed through the charger, thus partially discharging the film. The present invention provides a method and apparatus for lowering the voltage on the corona charger when the film is not in motion to a level where the corona charger emits neither light nor ions. Thus, the method and apparatus of the present invention solves the problem inhering in the prior art of the corona charger partially discharging the film on exit from the corona charger, and also serves to prevent overcharging of the film at low speeds and during stops.

A final problem long existing and unsolved in the prior art relates to multiple start and stop operations. During well logging operations, the film must be stopped and started periodically during its transport through the recorder in order to accurately record well log data. During low speeds or during stops, artifacts occur on the film in the form of large area grey or black marks. During stops, other artifacts, including black lines and multiple fine lines, occur.

The method and apparatus of the present invention, for the first time, provide precise control of the development electrode voltage, the corona charger, the liquid toner pump, the air knife, and fuser lamp, all combined to prevent and virtually eliminate objectionable artifacts from recordings.

In addition, the process and method of the present invention allows for complete integrated control of all of the foregoing functions resulting in high-quality recordings free of undesirable artifacts.

Thus, it is an object of the present invention to provide a process and apparatus for controlling the voltage on the development electrode of an electrophotographic recording device to match the voltage on electrophotographic film by accurately predicting and using dark decay rates over a wide range of times and film transport speeds.

It is a further object of the present invention to accurately control the toner fusing operation to produce quality recordings without heat or temperature damage to the film.

It is yet another object of the present invention to control the corona charger unit to preclude premature discharge of the electrophotographic film due to light from the corona charger unit, and further to prevent overcharging of the film at low film transport speeds and during stops.

It is yet another object of the present invention to provide complete control of the development electrode voltage, the corona charger, the toner pump, the air knife blower, and the fuser lamp, conjunctively, to preclude extraneous and objectionable artifacts on the film recording, and to produce high quality, clean recordings over a wide range of film speeds and ambient temperatures.

These and other objects, features and advantages of the invention will become evident in light of the following detailed description, viewed in conjunction with the referened drawings of a preferred electrophotographic recorder controller according to the invention. The foregoing and following description of the invention is for examplary purposes only. The true spirit and scope of the invention is set forth in the appended claims.

DETAILED DESCRIPTION OF THE INVENTION

Figure 1:
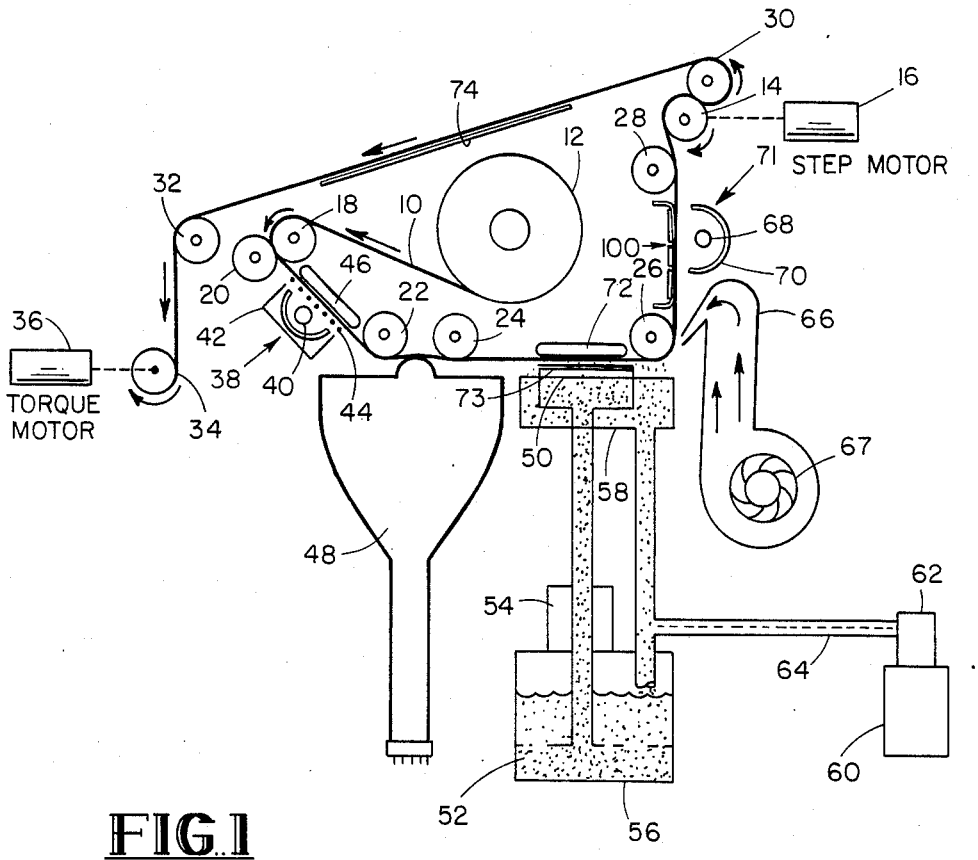
FIG. 1 is a schematic illustration of an electrophotographic film processor according to the present invention.

FIG. 1 is a schematic illustration of a typical electrophotographic recorder including a film heater platen according to the present invention. The recorder is typically mounted in a transportable cabinet.

Recording medium or film 10 may be a typical three layer film such as Eastman Kodak type SO-101. The three layers are a transparent polyester base, a center conductive layer, and a top layer which is a photoconductive dielectric. The center conductive layer (not shown) is electrically connected to a metal spool 12 on which the film is wound. Metal spool 12 is electrically connected to ground (not shown).

The movement of film 10 through the processor is governed by drive roller 14 and step motor 16. The typical driving circuit (not shown) for step motor 16 also provides output signals representing the advancement of the recording medium through the recorder. Guide rollers 18, 20, 22, 24, 26, 28, 30, and 32 generally comprise the film transport system and guide film 10 through the processor to takeup spindle 34 driven by torque motor 36. Rollers 20 and 30 also operate as pressure rollers which are spring-loaded against braking roller 18 and drive roller 14. The film transport system is typically mounted in the cabinet housing the recorder such that it can be raised to provide access to the inner recorder mechanism. Although not shown, an interlock switch is normally positioned such that raising the film transport assembly will cause that switch to make or break indicating the film transport system has been moved. As further described below, that switch will cause the process controller of the present invention to deactivate various portions of the system.

Film 10 is fed around first guide roller/braking roller 18 into a corona or other surface charge unit 38. Although shown schematically, such chargers typically have a small diameter wire 40 disposed in a conductive metal shell 42. When a high voltage, for example 4–7 kilovolts, is applied between wire 40 and shell 42, the air surrounding the wire is ionized and a flow of ions from the wire to the surface of film 10 results. Typically a grid 44 is used to control the amount of ions reaching the surface of film 10 and thus control the surface charge imparted to film 10. A platen 46 is typically disposed opposite charger 38 on the back side of film 10 to provide solid planar support and prevent film 10 from "fluttering". Charger unit 38 charges the surface of film 10 to a potential of +500 volts to +600 volts.

Guide rollers 22 and 24 direct film 10 over a fiber optic face plate of cathode ray tube ("CRT") 48. CRT 48 is operatively connected to well condition sensing units or other data gathering or storage devices which control the CRT display in known fashion. The fiber optic face plate of CRT 48 selectively exposes film 10 to record the desired data, generally in continuous graph form. The exposed areas of film 10 become conductive, and the surface voltage in those areas is reduced. The discharge path for film 10 is along the center conductive layer to film spool 12 and to ground. The surface voltage in the areas of film 10 selectively exposed by CRT 48 is typically reduced from between 500–600 volts to 250–300 volts.

Film 10 is next guided over toner head 50 and development electrode 73. Liquid toner 52 consists of toner particles suspended in an insulating or dielectric liquid carrier, and is pumped by toner pump 54 from a reservoir 56 through toner head 50 and development electrode 73 into contact with film 10. The toner particles suspended in liquid toner 52 are positively charged and are attracted to the selectively exposed areas of film 10. The toner particles are repelled from the unexposed background areas. After passing over the surface of film 10, the liquid toner 52 returns to reservoir 56 via toner sump 58 surrounding toner head 50. Liquid toner 52 is replenished from reservoir 60 by replenisher pump 62 and fluid conduit 64. A platen 72 is disposed closely adjacent toner head 50 on the opposite side of film 10 and provides a solid planar support surface similar to the function of platen 46 to prevent film 10 from "fluttering" during its movement over development electrode 73.

A typical air knife 66 or other pneumatic stripper means driven by air knife blower 67 is directed at an angle opposed to the forward movement of film 10 and serves to strip excess liquid from film 10 as it leaves toner head 50. The excess liquid returns to reservoir 56 through toner sump 58.

A platen 72 is disposed closely adjacent toner head 50 on the opposite side of film 10 and provides a solid planar support surface similar to the function of platen 46 to prevent film 10 from "fluttering" during its movement over development electrode 73.

Film 10 is next guided adjacent a fuser lamp 71 for fusing the toner particles to film 10, thus resulting in a permanent record. Fusing is accomplished through the use of a standard infrared lamp 68 and reflector 70. Infrared lamp 68 heats the toner particles to their melting point, thus fusing the toner into the surface of film 10.

Film 10 is thereafter driven around drive roller 14, guide pressure roller 30, over guide roller 32 and onto take-up spindle 34 driven by torque motor 36. As shown in FIG. 1, film 10 is also typically driven over an electroluminescent panel 74 for visually inspecting the recording.

Development Electrode

Toning the latent image on film 10 after it has gone through the exposing process over the fiber-optic face plate of CRT 48 has been one of the most difficult and critical processes in electrophotographic recording. It has long been known in the art, for example, that in order to achieve uniform toning, toner 52 must flow evenly between film 10 and a conductive surface, commonly known as a development electrode 73, which is usually spaced approximately 0.05" away from the surface of film 10.

Figure 2:
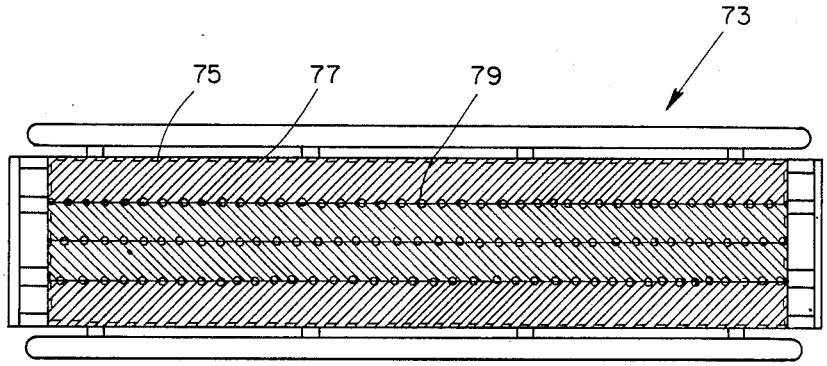
FIG. 2 is an illustration of a development electrode according to the present invention.

Referring to FIG. 2, the surface of the development electrode 73 of the present invention is formed into a plurality of alternating, diagonally positioned, parallel lands 75 and grooves 77. Lands 75 and groves 77 are oppositely sloped from the longitudinal axis of each set of throughholes 79 to provide a herring-bone pattern. The surface of development electrode 73 is coated with a conductive material in known manner connected to a source of potential thus resulting in a charged conductive surface adjacent film 10 as it moves over the electrode. Throughholes 79 allow liquid toner 52 to be pumped onto the surface of development electrode 73. Development electrode 73 is mounted in toner head 50 adjacent the path taken by film 10.

Prior art development electrodes, when tipped from the horizontal, allowed the liquid toner to flow, due to the force of gravity, to one edge or end thus resulting in non-uniform toner over the surface of the development electrode. That led to less than optimum recordings. The electrophotographic apparatus and method of the present invention, however, requires operation in rigorous environments where positioning in the horizontal plane is not always possible. Indeed, the method and apparatus of the present invention must provide for operation when tilted 10° or more from the horizontal plane.

The inventor discovered that the alternating, diagonally positioned, parallel lands 75 and grooves 77, as illustrated in FIG. 2, prevent liquid toner 52 from migrating too rapidly due to the force of gravity to the edges of electrode 73 and thus served to provide a substantially uniform layer of liquid toner 52 on the surface of electrode 73 over a range of angled increments from the horizontal.

Image Toning

It is well known in the art that the surface of development electrode 73 should optimally be biased with a voltage of the same polarity and at the same level as the voltage on the unexposed areas of film 10. The reason is the force acting on the toner particles in toner 52 is proportional to the difference between the voltage on film 10 and the voltage on the conductive surface of development electrode 73. In the case of equal voltages, the toner particles in toner 52 will be attracted to neither the film nor the development electrode. When the conductive surface of development electrode 73 holds voltages higher than the voltage on the unexposed areas of film 10, objectionable toning of those areas will result. If the development electrode 73 is operated at a voltage markedly lower than the voltage on film 10, toner is deposited on the development electrode. That results in decreased spacing between the film and the development electrode due to increasing toner deposits. Ultimately, film 10 would contact the conductive surface of development electrode. The accumulating and successively thicker layer of toner on the development electrode also acts as an insulator, reducing the effectiveness of the development electrode.

An additional related problem long existing and unremedied in the prior art is the inability of prior art electrophotographic systems to allow for an inherent natural charge decay in film 10 between charger 38 and toner head 50 and to adjust the voltage on the conductive surface of development electrode 73 accordingly. The result of that prior art inability has been less than optimum recordings.

Figure 3:
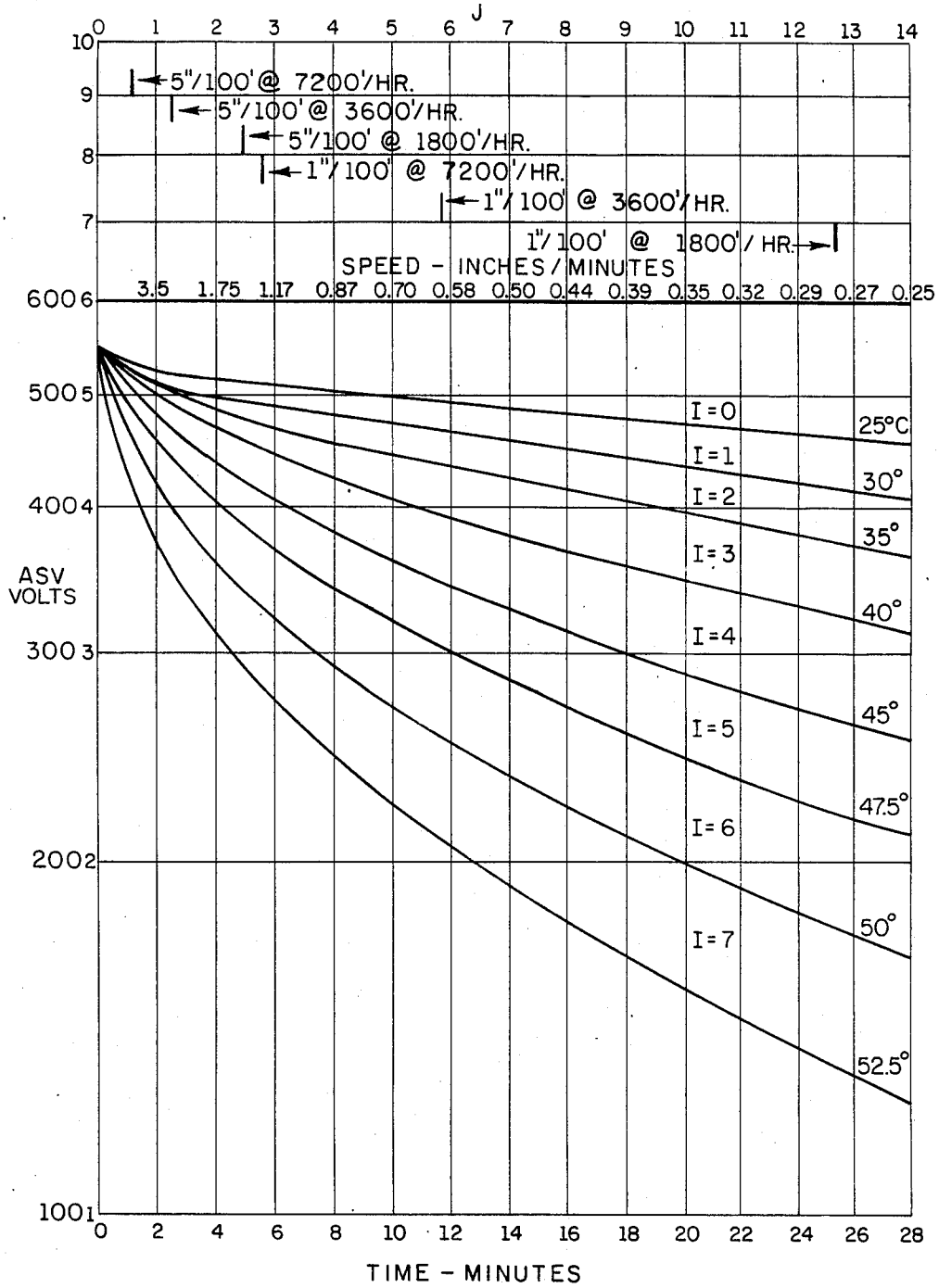
FIG. 3 is a graph for determining the dark decay rate of electrophotographic film and the corresponding development electrode voltage.

The voltage of the unexposed areas of film 10 over toner head 50 and development electrode 73 is a function of the initial voltage level imparted to film 10 under charger 38, the so-called "dark decay rate", and the elapsed time since the film was charged, namely the time between when a portion of film 10 exits charger 38 and the time that portion of film 10 exits toner head 50 and development electrode 73. The "dark decay rate", a time rate of change, as pointed about above, is the rate at which the voltage on film 10 decreases without exposure to light. FIG. 3 illustrates dark decay curves empirically developed by the inventor for Eastman Kodak type SO-101 film at eight different temperatures. Several scales are shown on the abcissa of FIG. 3. The time on the lower abcissa is time measured in minutes since charged, namely the time since a selected portion of film 10 leaves charger 38. The middle abcissa represents film throughput speed measured in inches per minute. The variable J (upper abcissa) and variable I (temperature curves) will be explained below in connection with constructing the development electrode voltage look-up table.

The length of the film path from the exit side of charger 38 to the exit side of toner head 50 and development electrode 73 in the exemplary electrophotographic film processor of FIG. 1 is 7.0 inches. Thus, a film speed of 3.5 inches per minute is equivalent to a time interval of 2.0 minutes. Throughput speeds for several typical logging speeds and film scales are illustrated on FIG. 3.

The wide variation in the dark decay rate illustrates that it is important to be able to either measure or predict the value of the voltage on film 10 at the time the film is in toner head 50 adjacent development electrode 73. It is not practical to physically measure the voltage on film 10 due to constraints of cost, size, and reliability of the necessary measuring equipment. Consequently, the voltage on film 10 must be predicted using data such as shown on FIG. 3. Those data were acquired by actual measurements made on typical film samples using a non-contact, feedback-type electrostatic volt meter. Those data, insofar as is known, are not otherwise available.

Those experimental decay data were used to develop an equation for dark decay. The curves shown in FIG. 3 can be represented by:

$$E=550(e^{-T/A})-B(20-T)$$

Where T=time in minutes, A is an equivalent RC factor, and B is a correction factor. A and B are functions of temperature. A varies from 135 at 25° C. to 20 at 50° C., and B varies from 1.0 at 25° C. to 5.0 at 50° C. That formula may thus be used to predict the value of the voltage on film 10 at toner head 50 using a dedicated hardware circuit or a microcomputer. However, the preferred embodiment is to store the data of FIG. 3 in a look-up table of M×N bytes, for example, 8×32 bytes. Eight temperature ranges and 32 2-minute time intervals have been found to give a sufficiently accurate development electrode voltage over a temperature range of 0°–50° C., and a 1-hour time period. Those temperature ranges and time periods are the usual ranges and periods necessary for use of electrophotographic recorders for well-logging processes.

The temperature variable can be relatively easily obtained using standard temperature sensors mounted so as to sense ambient temperature in the electrophotographic film processor cabinet. The time variable is more difficult to obtain. For steady-state conditions, when running at constant speed, conventional techniques such as counting the number of steps per unit time, or the number of clock pulses between steps, can be used. Indeed, presetting a counter with the number of 12 Hz pulses which have occurred since the last step, at each step moved by step motor 16, and then incremented at 2-minute intervals when stopped, would work under steady-state conditions. The problems discovered by the inventor, however, are that there are no data regarding the history of the 7 inches of film between charger 38 and toner head 50. Thus, when starting after a stop, the electrode voltage would have to be held constant for 7 inches of film 10 movement, with the electrode voltage thereafter increased to a level indicated by the speed at which the film is moving through the processor.

The other problem discovered by the inventor is that typical recorders seldom run at uniform step rates. An example is a 5"/100' log run at 1800 feet per hour. The average step rate is 5 steps/second, but those 5 steps are likely to occur in a "burst" of 5 steps in 25 milliseconds, with 975 milliseconds dead time between "bursts". That means the results obtained by counting 12 Hz pulses per step interval would have to be severely averaged.

The inventor discovered that the time variable may be obtained by dividing the distance, in the example 7 inches, between charger 38 and toner head 50 into small increments and measuring the time taken for each increment to move from charger 38 to the exit side of development electrode 73 of toner head 50. That increment can be fairly large because development electrode 73 is typically 2 inches wide and at that width will generally treat the 2 inches of film over it as if all of that film had the same charge history. An increment of approximately 0.4 inches would be sufficiently small.

Figure 4:
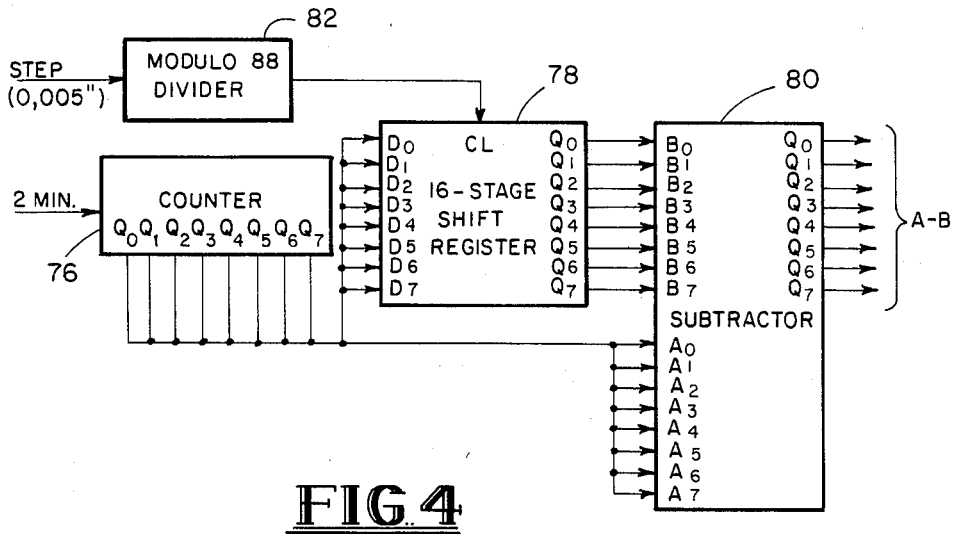
FIG. 4 is a block diagram of a circuit of the present invention for calculating development electrode voltage based on the dark decay rate.

FIG. 4 illustrates a schematic implementation. The circuit consists of an 8-bit time counter 76, a byte-wide 16-stage shift register 78, a subtractor 80, and a modulo 88 divider/step counter 82. Time counter 76 is incremented in 2-minute intervals. The output of time counter 76 is clocked into shift register 78 at 88-step (equalling 0.44") intervals. The output of shift register 78 is subtracted by subtractor 80 from the contents of time counter 76 at each 88-step interval, and at 2-minute intervals when motion is stopped. The output of subtractor 80 gives the time since an increment of film 10 just exiting development electrode 73 left corona charger 38. Shift register 78 contains the times when each of the 16 0.44" increments of film 10 left the charger 38, regardless of speed, length of run, or lengths of stops.

That result can also be obtained by implementing the system on a microcomputer. Sixteen (16) contiguous bytes of random access memory ("RAM") are allocated to store the time data using a standard register to accumulate time, a standard register or counter/timer to count step pulses (for example from step motor 16), and a register to sequentially address the 16 RAM locations. At 88-step intervals, the data are read from the currently addressed location, and subtracted from the current time. The current time is written in that location and the address register incremented. When stopped, the last data byte is subtracted from the current time at 2-minute intervals. The time counter will, of course, periodically cycle through 0, but that would not create error because it is known that the number representing current time must always be greater than any older data number. If a high speed start occurs after a stop, the rise time of the development electrode voltage may be limited by averaging several successive time values.

The electrode voltage data shown on FIG. 3 is preferably stored in a two-dimensional array of locations in the program memory of a microcontroller, for example an 8751 microcontroller. The address for each point in a table of M×N dimensions is given by:

$$\text{Address} = \text{base address} + [(N \times I) + J]$$

The base address is the location in ROM of the first element of the table, M and N are the dimensions of the table, and I and J are indices which represent the two variables. Index I ranges from 0 to M−1, and Index J ranges from 0 to N−1. In this case, eight (8) temperature ranges and thirty-two (32) time intervals are sufficient, thus M=8, N=32, I=0 to 7, and J=0 to 31. The range of addresses varies from:

Address=Base Address+[(32×0)+0]=Base Address, to:

Address=Base Address+[(32×7)+31]=Base Address+255.

The temperature ranges represented by the values of Index I are:

| Temperature | I |
|---|---|
| Less than 25° C. | 0 |
| 25–30° C. | 1 |
| 30–35° C. | 2 |
| 35–40° C. | 3 |
| 40–45° C. | 4 |
| 45–47.5° C. | 5 |
| 47.5–50° C. | 6 |
| 50–52.5° C. | 7 |

Index J represents time in two (2) minute intervals, from 0 to 62 minutes.

FIG. 3 is used directly by following the curve just below the I Index to the intersection with the J Index, and reading the voltage on the ordinate of the graph. Because the scale factor chosen is 2 volts/bit, the voltage value is divided by 2, and the resulting number is stored in ROM.

Image Fusing

A further problem long unremedied in the art is accurate control of the toner fusing lamp. The fusing operations under fuser lamp 71 in which the toner particles from toner fluid 52 are fused onto the surface of film 10 is complicated by the three variables of speed, ambient temperature, and AC line voltage. In order to achieve good adhesion and cohesion between the toner particles and film 10, the toner particles must be heated to approximately 80° C. However, polyester or plastic bases of a film 10, such as Eastman Kodak type SO-101, are permanently deformed at approximately 120° C., and tend to discolor at temperatures around 100° C.

In order to be useful for well logging recording operations, the fuser must provide good performance over a range of 0° to 55° C. (the temperature inside the recorder), with AC line voltages ranging from 105 to 130 volts, and at speeds from 0 to 1.2 inches per second. In order to minimize the power dissipation in the recorder, linear regulation of the AC voltage to fuser lamp 71 is undesirable. In order to minimize electrical transients, switching the line voltage is prohibited except at 0 crossings of the AC line voltage.

Figure 5:
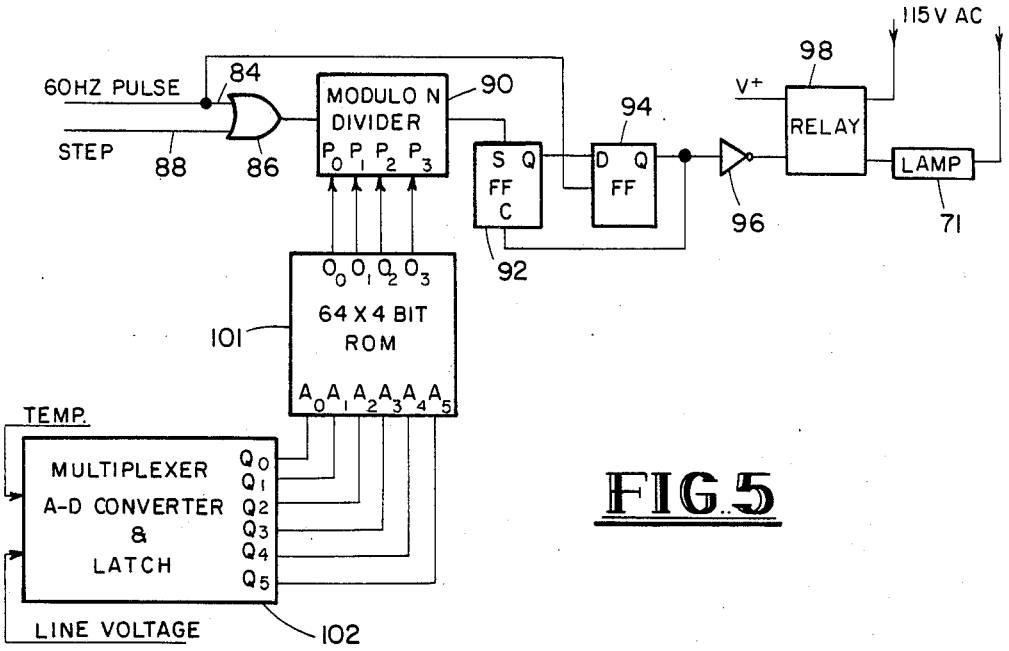
FIG. 5 is a block diagram of an automatic fusing lamp control circuit.

One of the principal features of the present invention is the ability to accurately regulate and control the fusing operation taking into account all variables affecting that operation. FIG. 5 is a block diagram of one embodiment of an automatic fuser controller 85 of the present invention which provides for regulating fuser lamp 71 in response to changes in speed, ambient temperature, and line voltage.

The automatic fusing lamp controller of the present invention allows power to be applied to fuser lamp 71 for one cycle of line voltage for every N steps of film 10 motion. In order to achieve good fusing at low speeds, and to avoid having fusing lamp 71 cool when stopped, 60 Hz pulses are fed along line 84 into logic OR circuit 86 with step pulses representing film 10 step increments input along line 88. The step rate is from 0 to 240 steps per second. The output of logic OR circuit 86 is input to a modulo N divider 90. With a step rate varying from 0 to 240 steps per second, the input to modulo-N divider 90 will vary from 60 to 300 pulses per second. Typical values of N are 8 or 9 for conditions where the ambient temperature is 25° C., and the line voltage is 115 volts. The inventor has discovered through empirical tests that N should be changed by one unit for each 5 volt change in line voltage and each 5° C. change in internal cabinet temperature. Those tests also revealed that at internal cabinet temperatures below 15° C., particularly at maximum speed and minimum line voltage, undesirable results occurred. Even at low speeds, an N value as low as 4 was required. Low values of N are, however, undesirable for two reasons. First, as N is made smaller, the percentage change becomes large, and at high speeds with a 50 Hz line frequency, fuser lamp 71 is on continuously with N less than or equal to 6.

Figure 6:
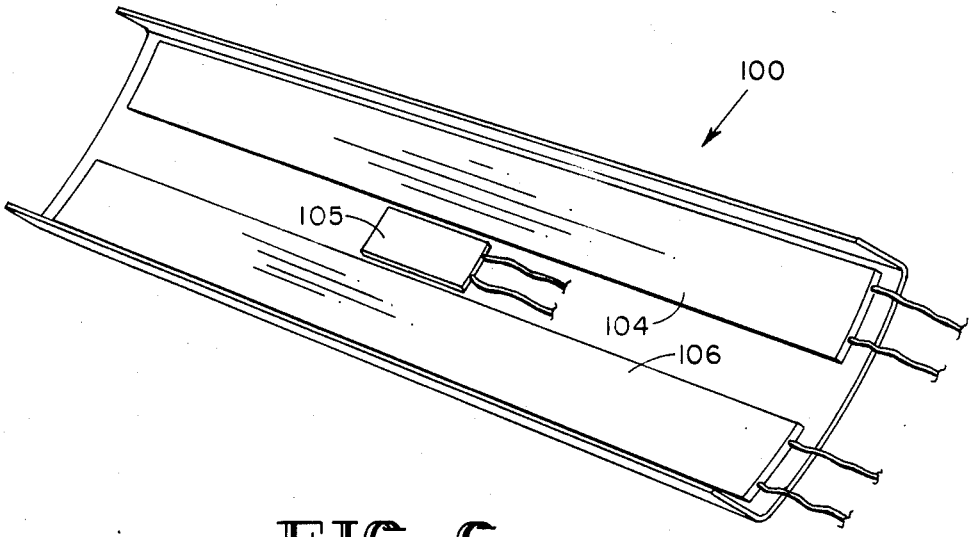
FIG. 6 is an illustration of a heated platen according to the present invention.

The inventor discovered that adding a preheater platen to the electrophotographic film processor solved the problem. Heated platens have, of course, been used, for example as disclosed in U.S. Pat. No. 3,533,784 to Granzow et al. issued Oct. 13, 1970, for fusing toner in electrostatic devices. However, in the present invention, a preheater platen operates in conjunction with the fuser lamp controller and serves to preheat the recording medium to allow precise control of the fusing operation. Referring to FIGS. 1 and 6, a preheater platen 100 is mounted opposite fuser lamp 71 on the back side of film 10. Resistance heaters 104 and 106 are vulcanized or otherwise adherred to the back side of platen 100. Additionally, a temperature sensor 105 is affixed to the back side of platen 100 such that the current temperature of the platen can be sensed and the platen temperature controlled to optimum ranges and prevent damage to film 10. Preheater platen 100 preferably preheats film 10 to a minimum temperature of 50° C., thus narrowing the temperature range required for the fuser lamp controller 85. The temperature of preheater platen 100 is controlled in response to the ambient temperature inside the electrophotographic processor case as will become clear from the description below.

Returning to FIG. 5, the output of modulo N divider 90 is output to the set input of flipflop 92. The Q output of flipflop 92 is input to the data or D input of flipflop 94, with the other input being connected to the 60 Hz line pulses on line 84. The output is inverted by inverter 96 operatively connected to relay 98 which, in turn, turns fuser 71 on and off. Thus, fuser lamp 72 will be turned on for one cycle of line voltage for every 10 steps of film motion.

The N inputs for modulo-N divider 90 preferably come from a 64×4-bit read only memory ("ROM") 101. The preferred ROM has a 6-bit address word; 3 bits for temperature and 3 bits for line voltage. Thus, 8 ranges for each of the variables, temperature and line voltage, can be covered. Temperature and line voltage are input from standard sensors to ROM 101 through a standard multiplexer, analog to digital converter, and latch 102.

Fusing lamp controller 85 may also be implemented using a microcomputer. In that event, control data may be stored in an 8×8 byte look-up table in ROM. The modulo-N divider can thus be eliminated.

Figure 7:
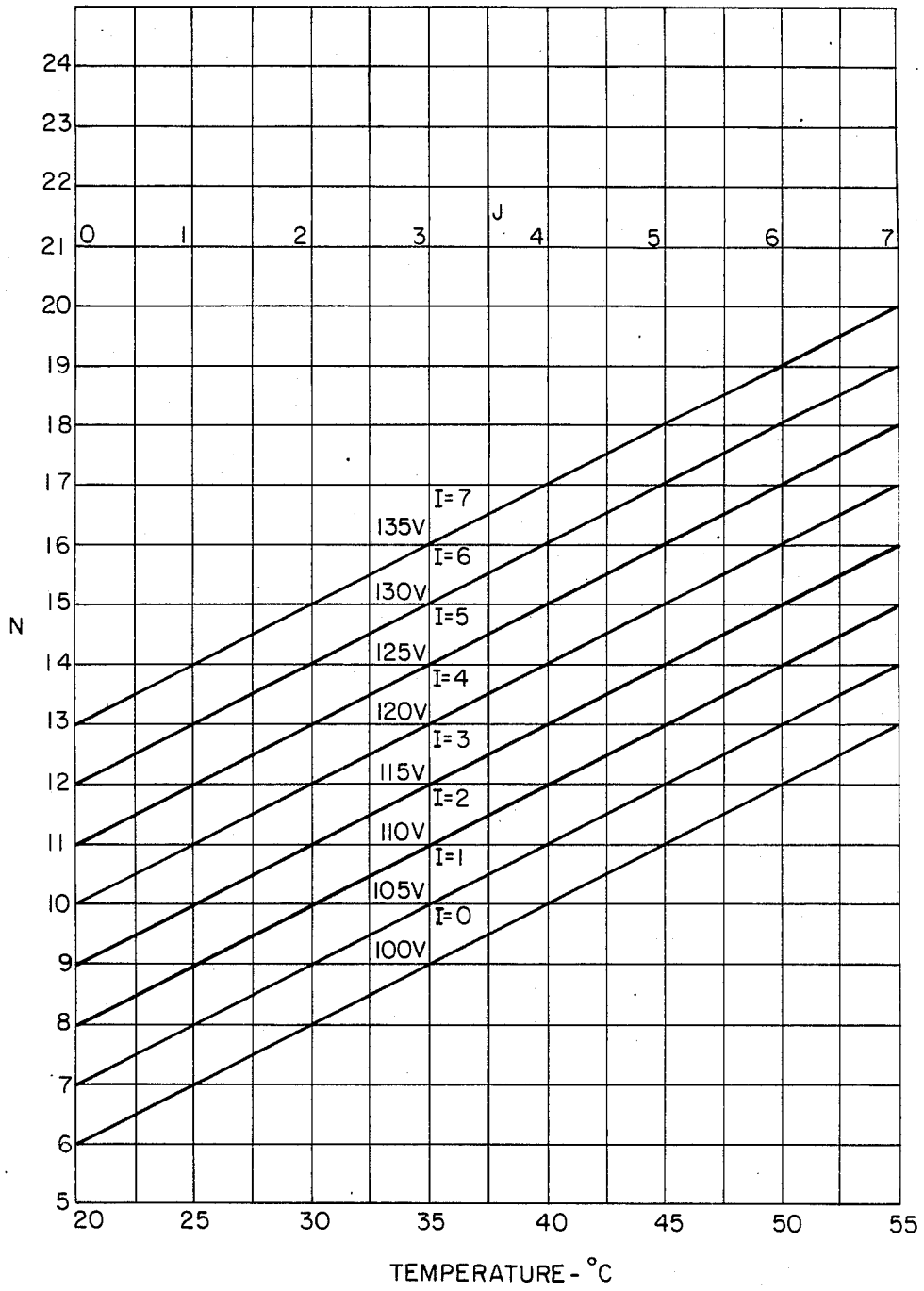
FIG. 7 is a graph for determining the fuser lamp variables.

FIG. 7 illustrates a graph for preparing the 8×8 byte fuser look-up table. The fuser look-up table is similar to the development electrode voltage table of FIG. 3, with the exceptions that it is smaller, and the variables are temperature and AC line voltage. In this case, M=N=8, and the values of both I and J range from 0 to 7. FIG. 7 illustrates the divider "N" required for fusing in temperatures of 20° to 55° C., and line voltages from 100 to 135 volts. For ambient temperatures inside the electrophotographic processor cabinet below 20° C., "N" should be set at the 20° value assuming the heated platen will pre-heat film 10 enough that lower volumes of "N" will not be required at temperatures below 20° C. The data illustrated in FIG. 7, could, of course, be extended in the N dimension.

Corona Charger

Corona charger 38 is similar to those used in standard photocopying machines. In continuous film electrophotographic processing, however, the inventor has discovered that the corona charger must be carefully controlled in order to prevent dark areas on the film at slow speeds or when stopped. That occurs because corona wire 40 (see FIG. 1) emits light as well as the ions which charge the film. That light can strike film 10 after it has passed through charger 38, thus partially discharging the film 10. Prior art attempts at solving the problem, for example, U.S. Pat. No. 3,533,784 to Granzow et al. involved pulsing the corona charge unit. The inventor has discovered that problem can be solved by lowering the voltage on corona wire 40, when film 10 is not in motion, to a point just below that at which light and ions are emitted. The lower voltage is chosen, however, to be just below the point at which light and ions are emitted in order to decrease the voltage change necessary, thus precluding long rise times. According to the present invention, the voltage on corona wire 40 is raised to +4.8 kilovolts for approximately 4 milliseconds during each step of film motion, and then reduced to +2.8 kilovolts during the intervals between steps. When operated at +2.8 kilovolts, a 2.0 mil. diameter wire emits neither light nor ions. That mode of operation also prevents overcharging of film 10 at low speeds and during stops.

Figure 8:
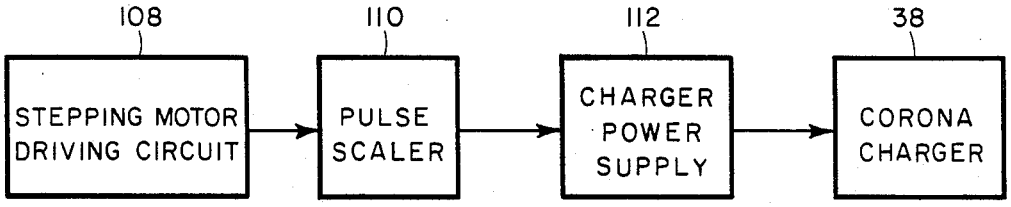
FIG. 8 is a block diagram of a corona charger control circuit.

An exemplary block diagram of a corona charger control circuit pursuant to the present invention is shown in FIG. 8. Input pulses from standard circuit 108 driving stepping motor 16 represent film movement steps and are first fed to a pulse scaler 110 which delivers a pulse of controlled amplitude to corona charger power supply 112. That pulse from pulse scaler 110 causes corona charger power supply 112 to deliver high power supply voltages to corona charger 38 during film steps, with a lower power supply voltage between steps.

Start and Stop Operation

Start and stop operations typically produce large grey areas and black marks on the film recording. The inventor has discovered, however, that careful control of development electrode 73 voltage in conjunction with control of corona charger 38, all as described above, prevents the "large-area" grey or black marks which would otherwise occur on recordings made on film 10 at low speeds or during stops.

However, the inventor also discovered two other objectionable artifacts which still occur during a stop. The first objectional artifact is a black line across film 10 at the exit side of toner head 50. That line occurs at the wet-dry interface on the surface of film 10, and is essentially the edge of a "water mark" type of discoloration. During a stop, the inventor has discovered that the "wet-dry" interface wavers back and forth, creating multiple fine lines which build up into what appears to be a single large black line.

The inventor has also discovered that the "water mark" artifact can be prevented by turning toner pump 54 off during a stop and letting the toner fluid between film 10 and toner head 50 drain back down into toner head 50. However, turning toner pump 54 off leads to another type of artifact characterized by faint or missing fine-line images adjacent the entrance side of toner head 50. The inventor has discovered that those defects are caused by air from air knife 66 blowing liquid along film 10 as toner pump 54 turns off. That liquid is conductive enough to allow re-charging of the fine-line image areas from the surrounding areas which have a high surface voltage. Those "missing image" artifacts, the inventor has discovered, can be prevented by turning the blower 67 of air knife 66 off. Because air knife 66 contributes to the incidental cooling of film 10 in the area of fuser lamp 71, it is also desirable to turn fuser lamp 71 off whenever air knife 66 is turned off.

Using the above control techniques, the inventor has found that excellent quality, artifact-free, recordings can be made which include stops of up to 30 minutes duration.

It is necessary, however, to allow toner pump 54, air knife 66, and fuser lamp 71 to reach normal operating levels before film 10 has moved more than approximately 0.5" on start-up after a stop. Limiting the speed of film 10 to 0.2" per second for 2 seconds will suffice. However, recorders of this type, particularly for its intended use in well logging operations, are slaves to the host computers of the data acquisition or processing system. Such systems cannot normally tolerate a delay of 2 seconds in executing commands or instructions. That is the reason for limiting the initial speed of the recorder. A limitation up to 0.2" per second corresponds to limiting the logging speed to 14,400 feet per hour with a 5"/100' depth scale. That is a reasonable starting speed for most and perhaps all real time logs. In the event data comes from high speed devices such as magnetic or optical disks, the recorder of the present invention can be "primed" a few seconds early, either manually or by a software command which could be as simple as telling the recorder to advance the film one step. A bit in a status word could tell the system when the recorder is "asleep", and that a "wake-up" call is necessary.

The speed of the recorder is limited by lengthening the existing STEP BUSY signal generated by typical recorders. That signal is presently generated for 4 milliseconds during each step of film motion. The speed can be limited by generating that signal for 24 milliseconds during each step, for the first 2 seconds of a recording.

The system according to the present invention further improves the quality of generated recordings by providing for sequenced turn-on and turn-off of toner pump 54, air knife 66, and fusing lamp 71. Toner pump 54 is turned on at the first motion step for film 10, then air knife 66 is turned on. The turn-off sequence is initiated whenever 30 seconds elapses without film motion. At that time, air knife 66 is turned off, then toner pump 54 is turned off after a one-second delay. Fusing lamp 71 is turned on and off with toner pump 54. During the first two seconds of the turn-on sequence, a 24 millisecond BUSY signal should be generated.

In actual use, the electrophotographic apparatus of the present invention is mounted in a transportable unit with the film 10 transport system mounted such that it can be raised to replace the supply of film 10, or otherwise gain access the other elements of the system. The method and apparatus of the present invention includes an interconnect for disabling heated platen 100, fusing lamp 71, and toner pump 54 as a result of a signal generated from interlock switches activated when the film transport is raised. Heated platen 100, fusing lamp 71, and toner pump 54 are also disabled when the sensor 105 on preheater platen 100 indicates platen temperature exceeds 70° C. in order to prevent film 10 from being damaged or discolored due to excess temperature.

Electrophotographic Process Control Circuit

Figure 9:
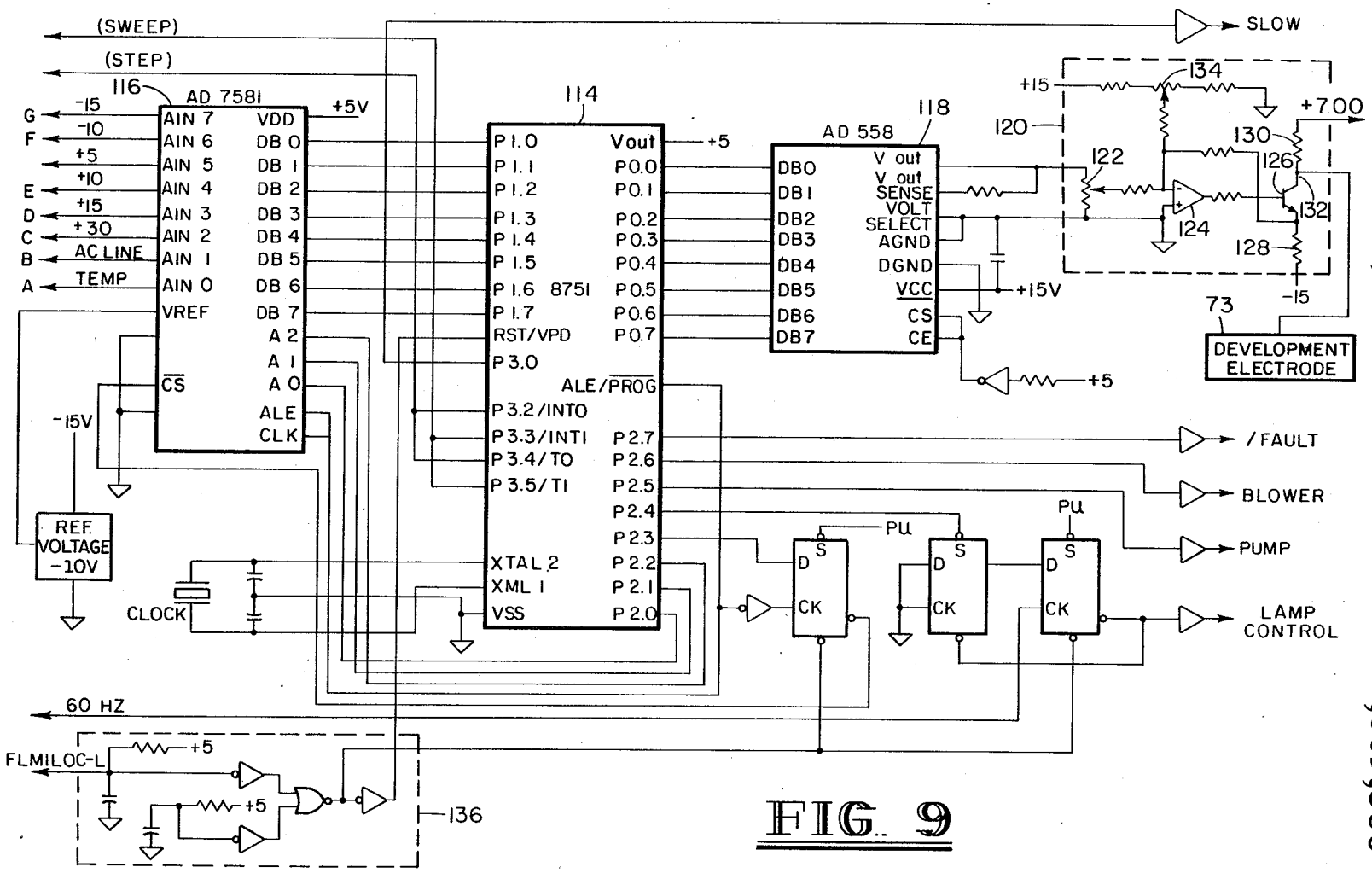
FIG. 9 is a schematic diagram of a portion of a processor control circuit according to the present invention.
Figure 10:
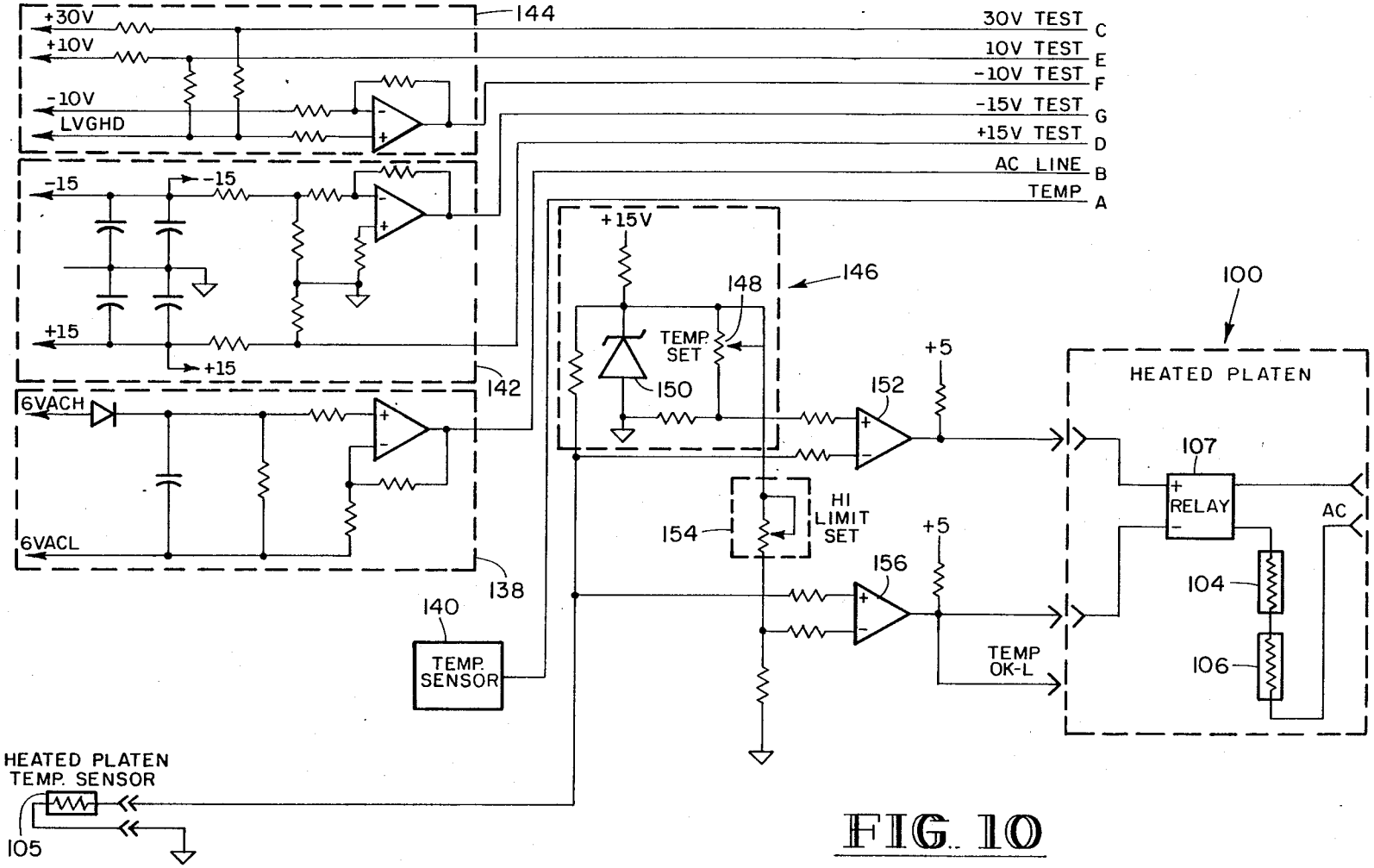
FIG. 10 is a schematic diagram of a portion of a processor control circuit according to the present invention illustrating the analog signal conditioning and heated platen control circuits.
Figure 11:
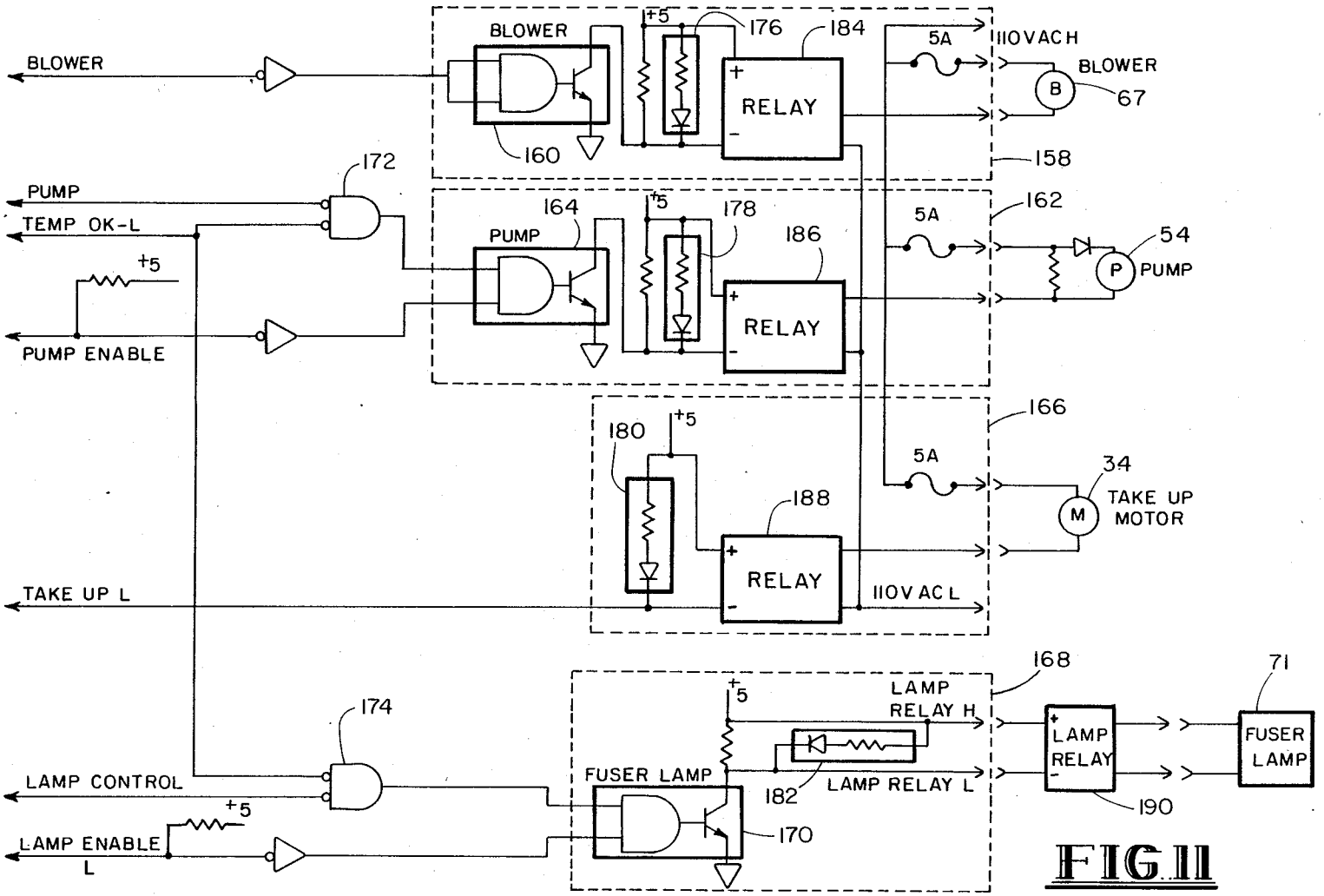
FIG. 11 is a schematic diagram of a portion of a processor control circuit according to the present invention illustrating the relay driver circuits.

An exemplary electrophotographic process control circuit for controlling all of the foregoing according to the present invention is illustrated schematically in FIGS. 9, 10 and 11. In general, a microcontroller 114, such as an 8751 microcontroller, controls development electrode 73, fusing lamp 71, toner pump 54, and air knife 66 by outputting signals to driver circuits (see FIG. 11) controlling those devices. The exemplary 8751 microcontroller contains an 8-bit CPU 4K bytes of erasable programmable read only memory ("EPROM"), 120 bytes of RAM, 21 special function registers, 32 input-output ("I/O") lines, and 2 16-bit counter/timers.

Figure 12:
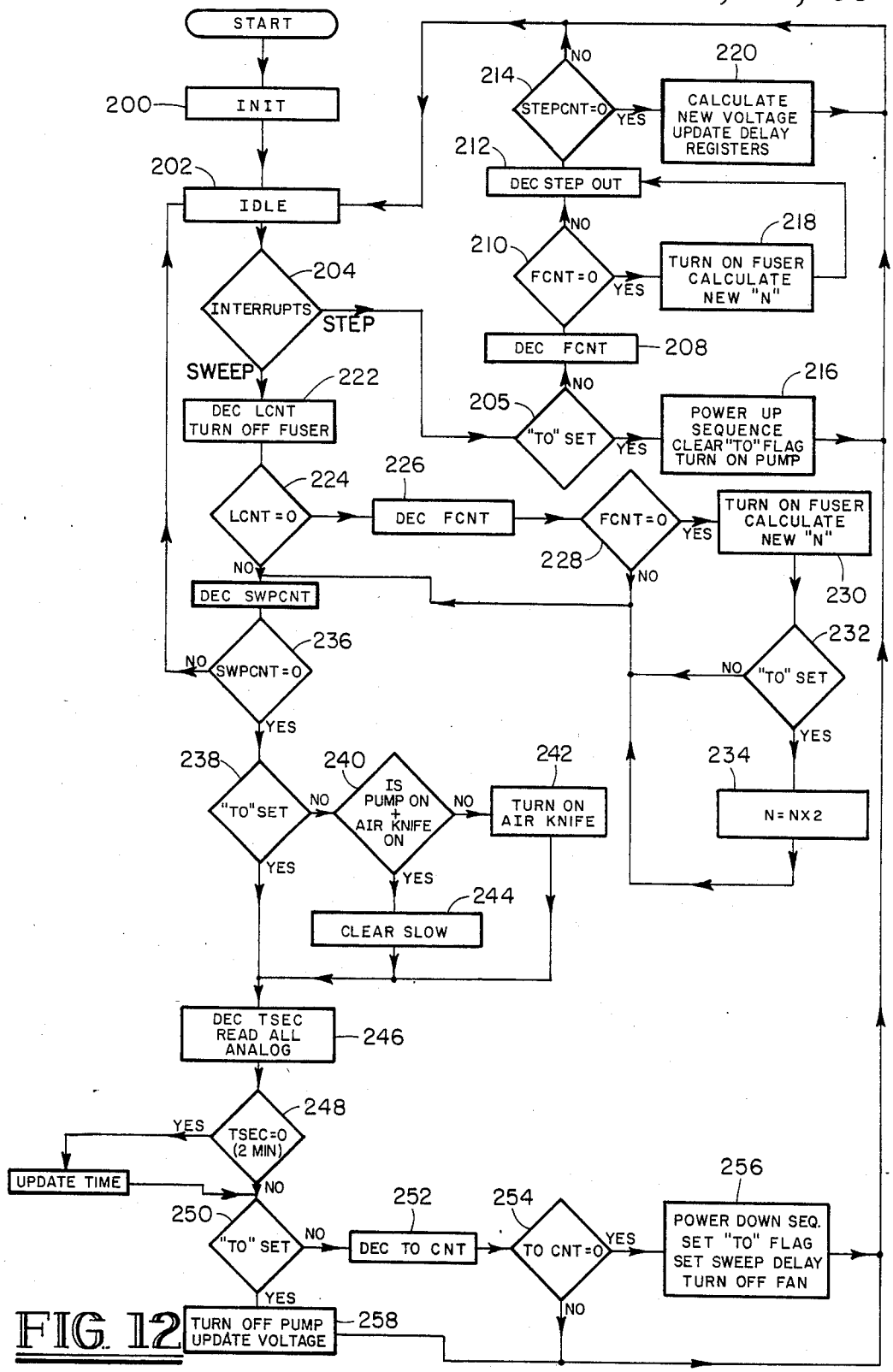
FIG. 12 is a flow chart illustrating a program for controlling the microcontroller of the processor controller circuit of the present invention.

With specific reference to the drawings, FIG. 9 illustrates an exemplary microcontroller circuit for implementing the present invention. FIG. 10 illustrates an analog signal conditioning and heated platen control circuit. FIG. 11 illustrates relay driver circuits controlled by the microcontroller circuit of FIG. 9 which in turn control the operation of the air knife blower 67, toner pump 54, takeup motor 34, and fuser lamp 71. FIG. 12 illustrates a flow-chart for a program implementing the operation of microcontroller 114.

First referring to FIG. 10, standard signal conditioning circuits 142 and 144 provide five analog signals in known fashion to the analog input ports of analog to digital converter 116 (see FIG. 9). Signal conditioning circuit 138 rectifies, filters, inverts and scales the 6 volt AC line voltage to provide an AC LINE signal which is proportional to the amplitude of the AC line voltage. A standard ambient temperature sensor 140 is mounted in the cabinet containing the electrophotographic recorder of the present invention in such position as to sense the ambient temperature in that cabinet and output a TEMP signal representing ambient temperature within that cabinet.

The heated platen control circuit also illustrated on FIG. 10 works as follows. Temperature sensor 105 mounted on heated platen 100 (see FIG. 6) constantly monitors the temperature of that platen. Temperature sensor 105 is connected to temperature set circuit 146 containing zener diode 150 and potentiometer 148. Potentiometer 148 is used to adjust the reference voltage level and hence the desired platen temperature. Comparator 152 compares the temperature set by potentiomter 148 to the actual platen temperature sensed by sensor 105 and controls heaters 104 and 106 on heated platen 100 during normal operation to provide a constant temperature. When the signal from sensor 105 is lower than the reference level, the comparator output is "high" and relay 107 is enabled. When the sensor 105 signal is higher than the reference voltage, comparator 152 output is "low" and relay 107 is disabled.

A further potentiometer 154 operates as a high-limit set providing a reference voltage representing the upper limit of temperature allowed for heated platen 100. As will be recalled from the foregoing discussion, toner particles must be heated to approximately 80° C. to achieve good adhesion and cohesion between the toner particles and film 10. The polyester or plastic base film, however, is permanently deformed at approximately 120° and tends to discolor at temperatures around 100° C. Thus, high limit set 154, in conjunction with the comparator 156, serves to set an upper limit reference voltage representing an upper limit temperature. Comparator 156 compares the reference voltage set by high limit set 154 against the signal representing actual temperature from temperature sensor 105, and outputs signals to heated platen 100 and a TEMP OK-L signal to the driver circuits of FIG. 11. Those signals are normally low. In the event temperature sensor 105 indicates a platen 100 temperature exceeding the high limit set by high limit set 154, comparator 156 outputs a high level signal disabling relay 107 controlling heaters 104 and 106 on heated platen 100, and also, through the TEMP OK-L signal, causes liquid toner pump driver circuit 164 and fuser lamp driver circuit 170 (FIG. 11) to turn pump 54 and fuser lamp 71 off.

Referring to FIG. 9, analog inputs, including those signals representing AC line voltage (AC LINE) and internal case ambient temperature (TEMP) from circuit 138 and temperature sensor 140 are input to analog to digital converter 116, such as an AD7581. The exemplary AD7581 contains an 8-channel multiplexer, 8-bit analog to digital converter, and an 8×8-bit RAM. The multiplexer and converter run continuously, sequentially sampling, converting, and storing data from each input. Data are transferred to Port 1 of microcontroller 114 when the chip select ("CS") input is enabled from the address defined by P2.0–P2.2. Analog to digital converter 116 is synchronized with microcontroller 14 by using the address latch enable ("ALE") signal from microcontroller 114 as the clock signal for the analog to digital converter. Each input will be sampled every 3.2 milliseconds if a 12 MHz clock frequency is used.

The other inputs to microcontroller 114 are the STEP signal and the SWEEP signal. The STEP signal is generated by the conventional circuit driving step motor 16 and occurs with each step of film 10 motion. The SWEEP signal occurs 240 times per second, synchronously with the horizontal sweep of CRT 48. Each of those signals is connected to both a counter/timer and an external interrupt input pin of port 3 of microcomputer 114. Using the SWEEP signal allows easy generation of long time intervals without counting the 12 MHz clock signal down to extremely low frequencies.

An initialization circuit 136 provides a reset signal to microcontroller 114 each time the film transport is lifted (FLMILOK-L signal from a standard interlock or switch), and each time a power-up pulse occurs due to initializing operation. Initialization circuit 136 also causes microcontroller 114 to generate an initialization "SLOW" output signal used to limit the speed of the transport during the first two seconds when starting after a stop as described above.

Port 1 of microcomputer 114 drives digital to analog converter 118, which, in the preferred embodiment, is an AD558. Digital to analog converter 118 generates a low level analog input signal for development electrode amplifier 120.

Development electrode amplifier 120 is a linear amplifier which must handle output levels greater than +500 volts. Digital to analog converter 118 delivers 0.040 V/bit, and the desired scale factors 2.0 V/bit. Thus, amplifier 120 must have a gain of 50. Amplifier 120 consists of an operational amplifier 124, for example a 741, and transistor 126, for example an SPT550. The feed-back signal for op-amp 126 is taken from the emitter of transistor 126, and the signal at the emitter will be:

$$\text{Emitter} = -\text{Ein}(100/249) = -0.402\text{Ein}$$

Because virtually all of the current which flows through emitter resistor 128 also flows through collector resistor 130, the signal at the collector 132 of transistor 126 will be:

$$\text{Eout} = 0.402\ \text{Ein}(2000/15.8) = 50.9\text{Ein}$$

The input to the amplifier is taken from potentiometer 122 which is used to adjust the gain between 0 and 50.9.

Potentiometer 134 provides an adjustable off-set to the output to any level between 30 and 345 volts. Potentiometers 122 and 134, therefore, allow for "fine tuning" of the amplifier for development electrode 73.

Port 2 of microcomputer 114 is used to address analog to digital converter 116 and for controlling fusing lamp 71, toner pump 54, and air knife blower 67.

Referring to FIG. 11, each of the control circuits, 158, 162, and 168, for air knife blower 67, liquid toner pump 54, and fuser lamp 71, respectively, control the operation of those devices through solid-state relays 184, 186, and 190, driven by one-half of DS3686 dual peripheral driver integrated circuit devices 160, 164 and 170. When the inputs to drivers 160, 164 and 170 are "low", the outputs are "high", and the associated relay, 184, 186 and 190, as the case might be, is deactivated. When the inputs to those drivers go "high", the outputs go "low" and the associated relay is turned on by the difference in voltage between the + and − inputs. Thus, for example, when the BLOWER signal at the input to driver 160 is "high", the output of driver 160 goes "low", relay 184 turns on, and blower 67 for air knife 66 is activated. The BLOWER signal comes from port 2 of microcontroller 114 (see FIG. 9).

Recalling that one of the features of this invention is the ability to turn liquid toner pump 54 off in the event film 10 is not stepped for a pre-determined period of time (TIME OUT) or the temperature of heated platen 100 exceeds the temperature set by high limit set 154 (see FIG. 10), the signal from microcontroller 114 (see FIG. 9) and TEMP OK-L signal from the heated platen control circuit (see FIG. 10) are fed to AND circuit 172. The output of AND circuit 172 and the PUMP ENABLE signal are the two inputs to driver 164 of liquid toner pump 54 control circuit 162. The PUMP signal is generated by microcontroller 114 (see FIG. 9), and goes "high" when film 10 has not moved for a predetermined period of time. The TEMP OK-L signal is generated by the heated platen control circuit (see FIG. 10), as described above, when the temperature on heated platen 100, as sensed by temperature sensor 105, exceeds the upper limit set by high limit set potentiometer 154. The PUMP ENABLE signal is generated by a service switch mounted to the electrophotographic recorder cabinet and is normally low. When the service switch is turned off, for maintenance operations, the PUMP ENABLE signal goes "high". Thus, if either the PUMP or TEMP OK-L signal indicate either that the temperature on heated platen 100 exceeds the pre-set upper limit or film 10 has not moved for a pre-determined time period, the output of driver 164 will go "high", relay 186 will deactivate and liquid toner pump 54 will turn off.

Similarly, it is a feature of the present invention to turn fuser lamp 71 off in the event film 10 has not moved for a predetermined period of time in response to the LAMP CONTROL SIGNAL from microcontroller 114, or if the temperature of heated platen 100 exceeds a predetermined upper limit (TEMP OK-L). Thus, those two signals are input to AND circuit 174, and the output is input to driver 170 of fuser lamp control 168. The other input to driver 170 is a LAMP ENABLE L signal which comes from a service switch mounted such that the LAMP ENABLE L signal is normally "low", but goes "high" in the event the electrophotographic recorder cabinet is opened and the film transport mechanism raised. Thus, if any one of the TEMP OK-L, LAMP CONTROL or LAMP ENABLE L signals indicates one of the foregoing conditions, the output of driver 170 will go "high" deactivating lamp relay 190 and turning fuser lamp 71 off.

The TAKE UP-L signal is also generated by a control switch mounted to the electrophotographic recorder cabinet and is normally low. When the control switch is turned "off", to load film, or to view a section already rolled on the take-up spool, the TAKE-UP L signal goes high, relay 188 is deactivated, and TAKE-UP motor 34 is turned off.

In the preferred embodiment, light-emitting diodes (LED's) 176, 178, 180, and 182 are connected across each relay input to provide a visual indication of the state of the relay driver.

In general terms, the software for microcontroller 114 provides the following functions.

On initialization, namely a power-up or whenever a RESET signal is generated, the program writes zeros in all 128 RAM locations, and then configures the I/O ports and counter/timers by moving data from EPROM to the control registers.

During data acquisition, the program reads data from all eight analog inputs to analog-digital converter 116 into Port 1 of microcontroller 114, and stores that data in RAM. The program then repeats that reading operation at 1-second intervals. Timing may be accomplished by either counting machine cycles, or using the 240 Hz SWEEP input. The program keeps time in a RAM location in 2-minute intervals.

The program controls fusing lamp driver 170 by reading ambient internal recorder temperature (TEMP) and AC line voltage (AC LINE) data from RAM, and uses that data to retrieve N from the $8\times8$ look-up table in ROM generated from FIG. 7. The program then loads a register with N, decrements the register once for each STEP and once for each fourth SWEEP signal. At zero, the program sets the lamp-control bit of port 2, and clears that bit within 8 milliseconds.

The program controls development electrode 73 voltage as follows. At 88-step intervals, the program reads one of 16 contiguous RAM locations containing OLDTIME, subtracts OLDTIME from NEWTIME, and uses the result and temperature to retrieve voltage data from the $8\times32$ look-up table in EPROM (see FIG. 3). The program writes that data to Port 1, writes NEWTIME to RAM, then increments the OLDTIME address counter. If the TIMEOUT flag is set, the program subtracts the last OLDTIME from NEWTIME at 2-minute intervals, retrieves voltage data from EPROM, outputs to port 1, but does not increment OLDTIME address.

For the Time-out and Time-off sequence, the program loads a register with 30 at each step, and then decrements the register at 1-second intervals. When the number in the register becomes zero, the program clears the air knife blower control bit in Port 2, then clears the pump control bit in Port 2 after one second.

In the Turn-on sequence, when the STEP signal occurs with the TIMEOUT set, the program sets the pump control bit in Port 2, sets the air knife blower control bit after one second, and clears the TIMEOUT flag.

The program may also provide for diagnostics. If RAM and EPROM capacity permits, all DC voltages input to analog to digital converter 116 can be periodically compared to reference values stored in EPROM and a HALT signal activated if any are out of range. The signal can be used to turn on a warning light, and can also be sent to a status input of the host recorder interface.

A flow diagram for a program for specifically implementing the above functions is illustrated in FIG. 12.

Referring to the flow chart on FIG. 12:

TSEC: Second Count Register (two minute generation)

TO: Time-out Flag

TOCNT: Time-out Count Register

SWPCNT: Sweep Count Register

STEPCNT: Step Count Register

LCNT: Line Cycle Count Register (240 Hz Sweep/4=60 Hz)

FCNT: Fuser Control Count Register

Upon power-up, all ports, variables and control registers are initialized (INIT) 200. The software is then put into an idle loop (IDLE) and from this point on is interrupt driven.

From the IDLE loop there are two interrupts which must be serviced. The first 204 is a step command which indicates whether the film has moved. Action is taken every 88 steps, which are counted in the step count register (STEPCNT), 214. At 88 step intervals, a new control voltage is looked up, 220, in the table and output to the control port. At every step a check is made to see if the system is asleep, that is not active for 30 seconds, by checking whether the time-out flag is set, 205. If the time-out flag is set, the POWER UP sequence 216 begins, the TIME OUT flag is cleared, and liquid toner pump 54 is turned on.

Another check is made to determine if N counts (FCNT) 210 have occurred, and if so, the fuser lamp 71 is turned on for one AC LINE cycle and a new value of N is calculated 218 from the look-up table generated from the graph of FIG. 7. Before returning from the interrupt, the TIME OUT COUNT REGISTER (TOCNT) is initialized to 30 seconds, that being the period of time which will cause a time-out if no steps occur.

The second interrupt is the SWEEP which occurs 240 times per second, or every 4 msec. That is the time base for the controller system. SWEEP is counted in the SWPCNT register to generate one second intervals and in the LCNT register to derive an accurate 60 Hertz signal for fuser lamp control. A check is made 228, at each sweep to determine if FCNT should be decremented. If it is decremented, a check is made to see if N COUNTS have occurred; and if so, the fuser lamp is turned on for one AC LINE cycle 230 and a new N is calculated. Every second, as determined by SWPCNT, a check is made to see if the system is asleep 232. If not, one of two paths is taken to insure a proper powerup sequence. The two-minute counter (TSEC) 246 is incremented each second, and every two minutes the time is up-dated 260.

A check is also made each second 250 to see if the time-out period has expired. If so, the shut-down sequence is started by turning the liquid toner pump 54 off one second after the time-out begins 258.

During the time the system is asleep, proper control voltage is maintained as long as possible and the fuser is turned on half as often during normal operations (N is set to N×2) 234.

In detail with reference to FIG. 12, on the STEP interrupt 204, if the timeout flag is set, 205, the power-up sequence begins by turning on liquid toner pump 54 and clearing the timeout flag 216. With the timeout flag cleared, the fuser control count register (FCNT) 208 is decremented to zero, 210, and fuser lamp 71 is turned on, 218. A new "N" value is calculated, 218, and the step count register decremented, 212, for calculating a new fuser voltage 220.

In the SWEEP interrupt, the sweep count register (SWPCNT) is decremented and the line count register (LCNT) is decremented, 222. The fuser count register (FCNT) is checked, 226 and 228, and fuser lamp 71 is turned on and a new "N" is calculated, 230. A check is made to see if the system is asleep, that is whether the TIME-OUT flag is set, 232, and if so the fuser is turned on half as often as it would during normal operation, 234, by setting "$N$"$=N\times 2$.

With the sweep count register decremented, a check is made to see whether the system is asleep, that is whether the TIME-OUT flag is set, 238, and if not, a check is made, 240, and air knife blower 67 are turned on. If so, SLOW is cleared, 244. If not, the air knife is turned on, 242.

The second count register (TSEC) is decremented, 246, and all analog inputs are read. At 2 minutes intervals, 248, time is updated, 260.

If 2 minutes have not elapsed, and the TIME-OUT flag is not set, 250, the timeout count register (TOCNT) is decremented, 252, and the program goes into a POWER DOWN sequence, 256, the TIME-OUT flag is set, the SWEEP DELAY is set, and the air knife blower 67 is turned off.

If the TIME-OUT flag is set, at 250, liquid toner pump 54 is turned off, 258.

The above program may be implemented in a variety of fashions on a variety of microcontrollers. The foregoing is for exemplary purposes only.

Thus, it is seen that the present invention provides a process and apparatus for accurately and continuously predicting the surface charge remaining on film 10 as it enters toner head 50 over a wide range of variables including time, temperature, and film transport speed. Moreover, it is seen that the method and apparatus of the present invention provides for accurately predicting that surface charge regardless of whether the operation of the film transport is continuous or intermitent. The method and apparatus of the present invention moreover provides means for varying the voltage on development electrode 73 in response to that predicted change in surface charge on film 10.

It is further seen that the method and apparatus of the present invention accurately controls the toner fusing operation by controlling the temperature of film 10 and the operation of fuser lamp 71 to produce quality recordings without temperature damage to film 10.

It is further seen that the method and apparatus of the present invention controls corona charger unit 38 to preclude premature discharge of film 10 due to light from that corona charger unit, and further prevents overcharging of film 10 at low film transport speeds and during stops.

It is also seen that the method and apparatus of the present invention provides complete control of development electrode 73 voltage, corona charger unit 38 voltage, liquid toner pump 54, the knife blower 67, and the fusing operation including heated platen 100 and fuser lamp 71, conjunctively, to preclude extraneous and objectionable artifacts on the film recording. The method and the apparatus of the present invention provides high quality, clean recordings over a wide range of film speeds and ambient temperatures.

Although the invention has been described in conjunction with the foregoing specific embodiment, many alternatives, variations and modifications will be apparent to those of ordinary skill in the art. Those alternatives, variations and modifications are intended to fall within the spirit and scope of the appended claims.

I claim:

1. Apparatus for improving the quality of recordings from electrophotographic recording apparatuses having a corona charging unit for imparting a surface charge to a recording medium, an exposing device for recording a latent image of data on said recording medium, a toning unit having means for bringing toner into contact with said recording medium and a development electrode, pneumatic means for removing excess toner, transport means for advancing said recording medium through said electrophotographic recording apparatus and which provides an output representing the rate at which the transport means advances the recording medium through said electrophotographic recording apparatus, and toner fusing means for fusing said toner to said recording medium, comprising:

temperature sensing means for sensing ambient temperature in said electrophotographic recording apparatus;

means for determining the time rate of change of the surface charge on said recording medium;

calculator means operatively connected to said means for determining the time rate of change, said temperature sensing means, and said transport means for continuously calculating the remaining charge on segments of recording medium adjacent the development electrode in response to changes in ambient temperature and the rate at which the recording medium is being advanced through said recording apparatus; and development electrode control means operatively connected to said development electrode and responsive to said calculating means for continuously varying the voltage of said development electrode to maintain the same potential as the remaining surface charge calculated by said calculator means for the segment of said recording medium adjacent the development electrode.

2. Apparatus for improving the quality of electrophotographic recordings as in claim 1, further comprising:

line voltage sensing means for sensing line voltage input to said electrophotographic recording apparatus, and wherein said calculator means is further operatively connected to said line voltage sensing means and calculates the optimum on-time for said toner fusing means based on current ambient temperature, changes in line voltage, and changes in the rate at which the recording medium is being advanced; and toner fusing control means operatively connected and responsive to said calculator means for varying the on-time for said toner fusing device to equal said optimum on-time.

3. Apparatus for improving the quality of electrophotographic recordings as in claim 2 further comprising:

corona charging unit control means operatively connected and responsive to said transport means for varying the voltage to said corona charging unit between at least two levels, a first level being a voltage sufficient to enable the corona charging unit to impart a surface charge to said recording medium, and a second level being a voltage lower than said first level and below that voltage at which said corona charging unit emits light and surface charge to said recording medium, whereby said corona charging unit control means causes said corona charging unit to operate at said first voltage level when said recording medium is being advanced through said recording apparatus, and at said second voltage level when said recording medium is stopped.

4. Apparatus for improving the quality of electrophotographic recordings as in claim 3 wherein said calculator means further comprises:

comparator means for comparing the rate at which said recording medium is being advanced through said recording apparatus to a predetermined time value, and for outputing a time-out signal in the event the recording medium has not been advanced for that predetermined time.

5. Apparatus for improving the quality of electrophotographic recordings as in claim 4 further comprising:

first control means operatively connected to said toning unit and responsive to said time-out signal from said comparator means of said calculator means for stopping the flow of toner into contact with said recording medium during the time said recording medium is stopped;

second control means operatively connected to said pneumatic means and responsive to said time-out signal from said calculator means for deactivating said pneumatic means during the time said recording medium is stopped; and third control operatively connected to said toner fusing means and responsive to said time-out signal from said calculator means for deactivating said toner fusing means during the time said recording medium is stopped.

6. A controller for an electrophotographic recording apparatus having an electrophotographic recording medium, a charger unit for imparting a surface charge to the surface of said electrophotographic recording medium, an exposing device for recording data on said electrophotographic recording medium, development electrode means for imparting toner to said electrophotographic recording medium, toner pump means for delivering toner through said development electrode into contact with said recording medium adjacent said development electrode, pneumatic blower means for directing a stream of air in a direction opposed to the movement of said recording medium to remove excess toner from said recording medium, fuser means for fusing said toner to said recording medium, and transport means for advancing said recording medium through said electrophotographic recording apparatus and which provides an output representing the rate at which the transport means advances the recording medium through said electrophotographic recording apparatus, comprising:

ambient temperature sensing means for sensing and outputting a signal representative of ambient temperature within said electrophotographic recording apparatus;

controller and calculator means operatively connected and responsive to said temperature sensing means and said transport means for continuously calculating remaining surface charge on that portion of said recording medium adjacent said development electrode based on the current ambient temperature and the rate of advancement of said recording medium, and means responsive to said controller and calculator means for continuously regulating the voltage on said development electrode to equal the surface charge on said recording medium adjacent said development electrode.

7. A controller for an electrophotographic recording apparatus as in claim 6, wherein said controller and calculator means further includes comparator means operatively connected to said transport means for comparing the rate at which said recording medium is being advanced through said electrophotographic recording apparatus to a predetermined time period and for generating a time-out signal in the event advancement of the recording medium has stopped for longer than said predetermined time period; and means operatively connected to said controller and calculator means, and to said fuser means, said pneumatic blower means, and said toner pump means for deactivating said fuser means, said pneumatic blower means, and toner pump means in response to said time-out signal.

8. A controller for an electrophotographic recording apparatus as in claim 6, further comprising;

platen means disposed in an opposed relation to said fuser means, said platen means having means for heating said platen and temperature sensing means for sensing the temperature of said platen means and outputting a signal representative of such temperature;

first comparator means for comparing said signal representing the temperature of said platen means with a first predetermined temperature and wherein said first comparator means is operatively connected to means for maintaining said platen at said predetermined temperature;

second comparator means for comparing said signal representing the temperature of said platen means with a second predetermined value representing maximum platen temperature, and outputting a signal in the event the temperature of said platen exceeds said second predetermined value; and means operatively connected and responsive to said signal from said second comparator means for deactivating said toner pump means and said fuser means.

9. A method for controlling the operation of an electrophotographic recording apparatus having a recording medium, charger means for imparting a surface charge to said recording medium, recording means for recording data on said recording medium, toning means for delivering toner into contact with said recording medium adjacent a development electrode, means to remove excess toner from said recording medium, means for fusing said toner to said recording medium, and transport means for advancing said recording medium through said electrophotographic recording apparatus, and which provides an output representing the rate at which the transport means advances the recording medium through said electrophotographic recording apparatus, said method comprising:

sensing ambient temperature in said electrophotographic recorder apparatus;

calculating the time rate of change of the surface charge on said recording medium for the current ambient temperature in said electrophotographic recording apparatus;

calculating the remaining surface charge for that segment of recording medium adjacent said development electrode based on the time since that segment of recording medium received a surface charge, the rate at which the recording medium is being advanced, and time rate of change of the surface charge, on a continuous basis, as the recording medium moves through the electrophotographic recording apparatus;

controlling the voltage on said development electrode to equal the calculated surface charge on the segment of recording medium adjacent said development electrode.

10. A method as in claim 9, wherein said remaining surface charge is calculated using:

$$E=550(e^{-T/A})-B(20-T)$$

where T=times in minutes, A is an equivalent RC factor, B is a correction factor, and wherein A varies from 135 at 25° C. to 20 at 50° C., and B varies from 1.0 at 25° C. to 5.0 at 50° C.

11. A method as in claim 10, wherein said development electrode voltage is calculated by constructing a look-up table of M×N dimensions with the address for each point in said table being given by:

$$\text{Address}=\text{Base Address}+[(N\times I)+J]$$

wherein the base address is the location of the first element of said table, M and N are the dimensions of said table, I represents the ambient temperature in said recording apparatus, J represents time, and wherein I ranges from 0 to M−1 and J ranges from 0 to N−1.

12. The method as in claim 11, wherein M=8, N=32, and I varies within the following ranges:

| TEMPERATURE | I |
|---|---|
| Less than 25° C.-0 | 0 |
| 25-30° C. | 1 |
| 30-35° C. | 2 |
| 35-40° C. | 3 |
| 40-45° C. | 4 |
| 45-47° C. | 5 |
| 47.5-50° C. | 6 |
| 50-52.5° C. | 7 |

and wherein $J=0-31$ representing time in two minute intervals from 0 to 62 minutes.

13. The method as in claim 12 wherein said look-up table is contructed in a memory device capable of being automatically accessed by a microcontroller.

14. The method as in claim 9, further comprising:

calculating the optimum on-time for said fuser means in response to changes in line voltage, ambient temperature, and recording medium advancement rate to produce proper fusing and prevent overheating of said recording medium;

controlling the on-time of said fuser means to equal the calculated optimum on-time.

15. The method as in claim 14, wherein said step of controlling comprises:

applying power to said fuser means for one cycle of line voltage for every N steps of recording medium movement, wherein N is determined empirically to produce properly fused toner without damage to the recording medium over a range of ambient temperatures and line voltages.

16. The method as in claim 15, wherein N varies linearly within the following ranges over ambient temperature of 20° C.-55° C.:

| Line Voltage | N |
|---|---|
| 100 V | 6-13 |
| 105 V | 7-14 |
| 110 V | 8-15 |
| 115 V | 9-16 |
| 120 V | 10-17 |
| 125 V | 11-18 |
| 130 V | 11-19 |
| 135 V | 13-20 |

17. A method as in claim 14, further comprising:

preheating said recording medium to a predetermined temperature prior to fusing said toner to said recording medium.

18. A method as in claim 17, wherein said step of preheating comprises disposing a controllable heated platen adjacent the recording medium opposite said fuser means, and controlling the temperature of said heated platen to maintain the temperature of said heated platen at said predetermined temperature.

19. A method as in claim 18, further comprising:

continuously sensing the temperature of said heated platen, comparing that temperature to a predetermined maximum temperature, and deactivating said fuser means and said toning means in the event the temperature of the heated platen exceeds the predetermined maximum temperature.

20. A method as in claim 9, further comprising:

controlling said charger means in response to the rate of advancement of said recording medium, wherein said charger means is operated at a first voltage level of sufficient magnitude to create a surface charge on said recording medium during advancement of said recording medium, and a second lower voltage below the voltage at which said charger means emits light and surface charge to said recording medium during the time advancement of said recording medium is stopped.

21. A method as in claim 9, further comprising:

continually sensing whether said recording medium is being advanced through said recording apparatus;

comparing the time over which said recording medium is not being moved through said recording apparatus to a predetermined value;

deactivating said toning means, said means to remove excess toner, and said fusing means in the event movement of said recording medium through said recording apparatuses is stopped for longer than said predetermined time.

* * * * *